US010791391B2

(12) United States Patent
Ong

(10) Patent No.: US 10,791,391 B2
(45) Date of Patent: Sep. 29, 2020

(54) HEADSETS AND METHODS FOR CONFIGURING A HEADSET

(71) Applicant: RAZER (ASIA-PACIFIC) PTE. LTD., Singapore (SG)

(72) Inventor: Lawrence Xian Jie Ong, Singapore (SG)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 0 days.

(21) Appl. No.: 16/319,286

(22) PCT Filed: Jul. 20, 2016

(86) PCT No.: PCT/SG2016/050344
§ 371 (c)(1),
(2) Date: Jan. 18, 2019

(87) PCT Pub. No.: WO2018/017012
PCT Pub. Date: Jan. 25, 2018

(65) Prior Publication Data
US 2019/0281379 A1 Sep. 12, 2019

(51) Int. Cl.
*H04R 1/10* (2006.01)
*H04R 5/033* (2006.01)

(52) U.S. Cl.
CPC ..... *H04R 1/1066* (2013.01); *H04R 1/105* (2013.01); *H04R 1/1008* (2013.01); *H04R 1/1075* (2013.01); *H04R 5/033* (2013.01); *H04R 5/0335* (2013.01); *H04R 2201/025* (2013.01); *H04R 2205/022* (2013.01); *H04R 2420/09* (2013.01)

(58) Field of Classification Search
CPC .... H04R 1/1066; H04R 1/1008; H04R 1/105; H04R 1/1075; H04R 5/0335; H04R 2205/022; H04R 5/033; H04R 2201/025; H04R 2420/09
See application file for complete search history.

(56) References Cited

U.S. PATENT DOCUMENTS 3,356,797 A 12/1967 Konzelmann et al.
3,751,608 A 8/1973 Weingartner
4,783,822 A 11/1988 Toole et al.
(Continued)

FOREIGN PATENT DOCUMENTS

CN 101455092 A 6/2009
DE 2541332 A1 3/1977
(Continued)

OTHER PUBLICATIONS

International Search Report and Written Opinion, dated Apr. 14, 2017, for the corresponding International Application No. PCT/SG2016/050344 in 8 pages.
(Continued)

*Primary Examiner* — Jason R Kurr
(74) *Attorney, Agent, or Firm* — Polsinelli PC

(57) ABSTRACT

According to various embodiments, a headset may be provided. The headset may include: a speaker having a main sound emission direction; and a movement member configured to effect movement of the speaker along a pre-determined path at least substantially perpendicular to the main sound emission direction upon actuation of the movement member.

16 Claims, 6 Drawing Sheets

(56) References Cited

U.S. PATENT DOCUMENTS

| | | | | |
|---|---|---|---|---|
| 5,533,137 | A * | 7/1996 | Holmes | H04R 1/1066 381/370 |
| 5,784,477 | A * | 7/1998 | Konig | H04R 5/033 381/309 |
| 6,546,264 | B1 | 4/2003 | Kennedy | |
| 7,072,438 | B2 | 7/2006 | Chiba et al. | |
| 7,697,709 | B2 | 4/2010 | Mei et al. | |
| 8,311,258 | B2 | 11/2012 | Lin et al. | |
| 8,515,103 | B2 | 8/2013 | Mei et al. | |
| 9,031,275 | B2 | 5/2015 | Brødsgaard | |
| 9,258,636 | B2 | 2/2016 | Nakano et al. | |
| 2006/0291685 | A1 * | 12/2006 | Chou | H04R 1/1066 381/381 |
| 2008/0031481 | A1 | 2/2008 | Warren et al. | |
| 2010/0040245 | A1 | 2/2010 | Buil et al. | |
| 2010/0128905 | A1 | 5/2010 | Warren et al. | |
| 2015/0163581 | A1 | 6/2015 | Blonder | |
| 2015/0280677 | A1 | 10/2015 | Hui | |
| 2015/0358720 | A1 | 12/2015 | Campbell | |

FOREIGN PATENT DOCUMENTS

| | | | |
|---|---|---|---|
| DE | 4110902 | A1 | 10/1992 |
| DE | 102012106318 | A1 | 1/2014 |
| EP | 1318692 | A1 | 6/2003 |
| JP | 2000-270390 | A | 9/2000 |
| KR | 20-0210155 | Y1 | 1/2001 |
| WO | WO 02/25990 | A1 | 3/2002 |
| WO | WO 2002/065809 | A1 | 8/2002 |
| WO | WO 2013/111298 | A1 | 8/2013 |

OTHER PUBLICATIONS

Extended European Search Report dated Apr. 15, 2019, 8 pages, for the corresponding European Patent Application No. 16909628.6.
European Examination Report dated Feb. 26, 2020, 5 pages, for the corresponding European Patent Application No. 16909628.6.
Office Action (including English Translation) dated Jun. 30, 2020, for the corresponding Chinese Application No. 201680089320.6 in 13 total pages.

* cited by examiner

200

HEADSETS AND METHODS FOR CONFIGURING A HEADSET

TECHNICAL FIELD

Various embodiments generally relate to headsets and methods for configuring a headset.

BACKGROUND

Commonly used discrete drivers for surround technologies in audio devices are often inaccurate given that every individual has a unique response to simulated sound stages. For example, particular shapes of the users' ears may be different and the drivers of the headphones may not be able to compensate. Thus, there may be a desire for enhanced audio devices.

SUMMARY OF THE INVENTION

According to various embodiments, a headset may be provided. The headset may include: a speaker having a main sound emission direction; and a movement member configured to effect movement of the speaker along a pre-determined path at least substantially perpendicular to the main sound emission direction upon actuation of the movement member.

According to various embodiments, a method for configuring a headset with a speaker having a main sound emission direction may be provided. The method may include actuating a movement member to effect movement of the speaker along a pre-determined path at least substantially perpendicular to the main sound emission direction.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which.

DETAILED DESCRIPTION

Figure 1A:
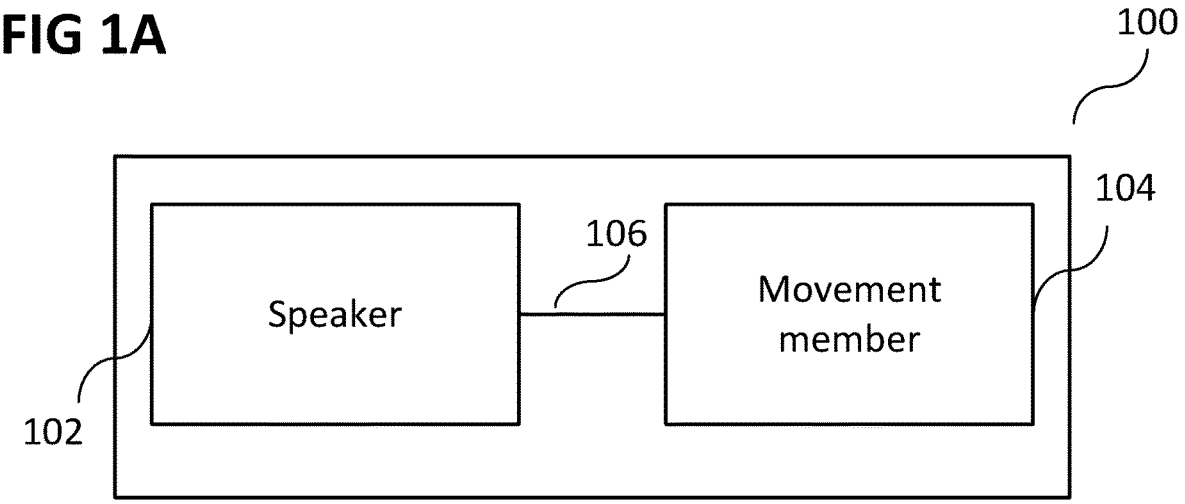
FIG. 1A shows a headset according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

In this context, the headset as described in this description may include a memory which is for example used in the processing carried out in the headset. A memory used in the embodiments may be a volatile memory, for example a DRAM (Dynamic Random Access Memory) or a non-volatile memory, for example a PROM (Programmable Read Only Memory), an EPROM (Erasable PROM), EEPROM (Electrically Erasable PROM), or a flash memory, e.g., a floating gate memory, a charge trapping memory, an MRAM (Magnetoresistive Random Access Memory) or a PCRAM (Phase Change Random Access Memory).

In an embodiment, a "circuit" may be understood as any kind of a logic implementing entity, which may be special purpose circuitry or a processor executing software stored in a memory, firmware, or any combination thereof. Thus, in an embodiment, a "circuit" may be a hard-wired logic circuit or a programmable logic circuit such as a programmable processor, e.g. a microprocessor (e.g. a Complex Instruction Set Computer (CISC) processor or a Reduced Instruction Set Computer (RISC) processor). A "circuit" may also be a processor executing software, e.g. any kind of computer program, e.g. a computer program using a virtual machine code such as e.g. Java. Any other kind of implementation of the respective functions which will be described in more detail below may also be understood as a "circuit" in accordance with an alternative embodiment.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The reference to any prior art in this specification is not, and should not be taken as an acknowledgement or any form of suggestion that the referenced prior art forms part of the common general knowledge in Australia (or any other country).

In order that the invention may be readily understood and put into practical effect, particular embodiments will now be described by way of examples and not limitations, and with reference to the figures.

Various embodiments are provided for devices, and various embodiments are provided for methods. It will be understood that basic properties of the devices also hold for the methods and vice versa. Therefore, for sake of brevity, duplicate description of such properties may be omitted.

It will be understood that any property described herein for a specific device may also hold for any device described herein. It will be understood that any property described herein for a specific method may also hold for any method described herein. Furthermore, it will be understood that for any device or method described herein, not necessarily all the components or steps described must be enclosed in the device or method, but only some (but not all) components or steps may be enclosed.

The term "coupled" (or "connected") herein may be understood as electrically coupled or as mechanically coupled, for example attached or fixed, or just in contact without any fixation, and it will be understood that both direct coupling or indirect coupling (in other words: coupling without direct contact) may be provided.

Commonly used discrete drivers (in other words: speaker drivers; in other words: speakers) for surround technologies in audio devices are often inaccurate given that every individual has a unique response to simulated sound stages. For example, particular shapes of the users' ears may be different and the drivers of the headphones may not be able to compensate. According to various embodiments, enhanced audio devices may be provided.

According to various embodiments, a 3D (three dimensional) mechanical audio calibration system may be provided. According to various embodiments, a 3D mechanical audio positional audio calibration system may be provided.

According to various embodiments, users may adjust the position of the headset audio drivers to fit their preference via a series of dials and knobs.

FIG. 1A shows a headset 100 according to various embodiments. The headset 100 may include a speaker 102 (in other words: a driver) having a main sound emission direction. The headset 100 may further include a movement member 104 configured to effect movement of the speaker 102 along a pre-determined path (in other words: track) at least substantially perpendicular to the main sound emission direction upon actuation of the movement member 104. The speaker 102 and the movement member 104 may be coupled with each other, like indicated by line 106, for example electrically coupled, for example using a line or a cable, and/or mechanically coupled.

In other words, according to various embodiments, a lateral position of a speaker 102 in a headset 100 may be changed by actuating a movement member 104.

According to various embodiments, the movement member 102 may include or may be or may be included in a dial (or a knob).

Figure 1B:
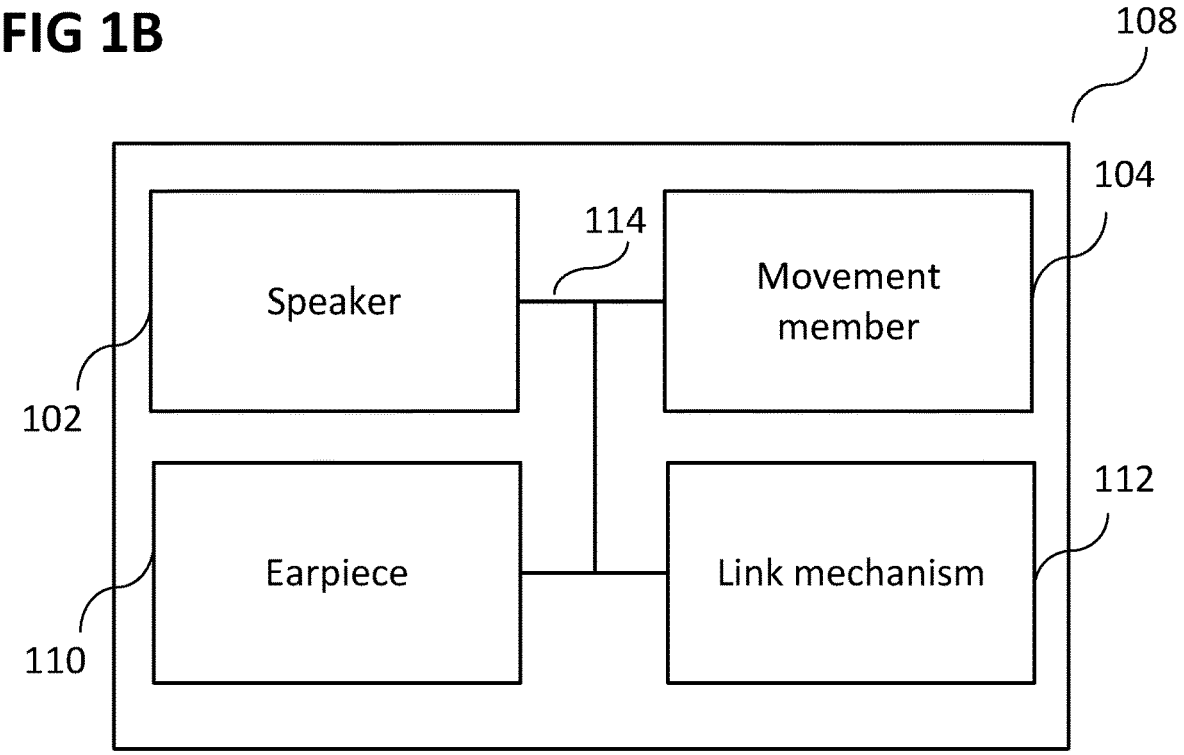
FIG. 1B shows a headset according to various embodiments.

FIG. 1B shows a headset 108 according to various embodiments. The headset 108 may, similar to the headset 100 of FIG. 1A, include a speaker 102 having a main sound emission direction. The headset 108 may, similar to the headset 100 of FIG. 1A, further include a movement member 104 configured to effect movement of the speaker 102 along a pre-determined path at least substantially perpendicular to the main sound emission direction upon actuation of the movement member 104. The headset 108 may further include an earpiece 110, like will be described in more detail below. The headset 108 may further include a link mechanism 112, like will be described in more detail below. The speaker 102, the movement member 104, the earpiece 110, and the link mechanism 112 may be coupled with each other, like indicated by lines 114, for example electrically coupled, for example using a line or a cable, and/or mechanically coupled.

According to various embodiments, the earpiece 110 may house the speaker 102. According to various embodiments, the movement member 104 may be mounted on the earpiece 110.

According to various embodiments, the link mechanism 112 may include a first link, a second link, and a third link. According to various embodiments, the speaker 102 may be mounted on the first link and on the second link.

According to various embodiments, the first link may include a rail. According to various embodiments, the speaker 102 may be mounted in (or on) the rail.

According to various embodiments, the speaker 102 may be mounted to a first end of the second link.

According to various embodiments, the second link and the third link may be pivotally connected.

According to various embodiments, the third link and the first link may be pivotally connected.

According to various embodiments, the headset 108 may include a plurality of speakers (for example one of them being speaker 102) and a respective movement member for each speaker of the plurality of speakers (for example movement member 104 for speaker 102).

According to various embodiments, the main sound emission direction may be at least substantially towards a user's ear (in other words: towards an ear of a user of the headset 108).

According to various embodiments, a direction of the movement of the speaker 102 may be up or down with respect to the user's head.

According to various embodiments, a direction of the movement of the speaker 102 may be front or back with respect to the user's head.

According to various embodiments, the headset 108 may be configured according to at least one of Dolby or DTS.

According to various embodiments, the speaker 102 may include or may be at least one of a left driver, a right driver, a back left driver, a back right driver, or a middle driver.

Figure 1C:
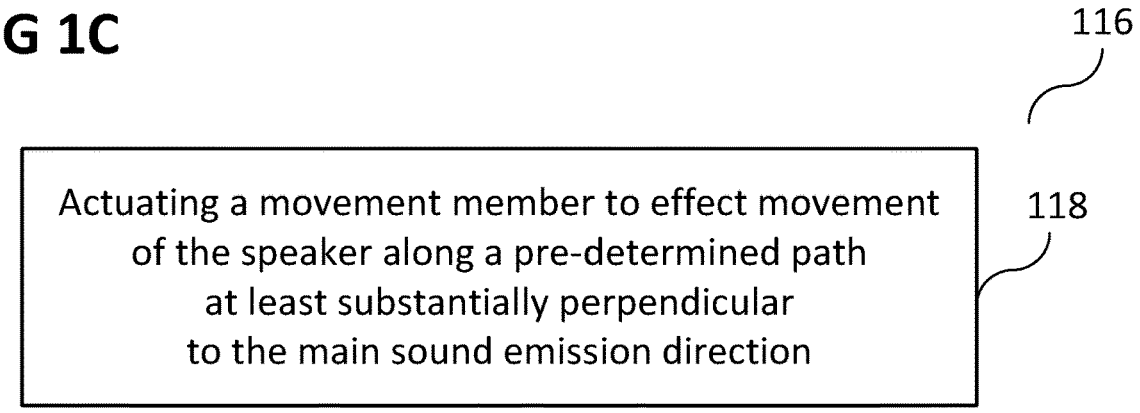
FIG. 1C shows a flow diagram illustrating a method for configuring a headset according to various embodiments.

FIG. 1C shows a flow diagram 116 illustrating a method for configuring a headset with a speaker having a main sound emission direction according to various embodiments. In 118, a movement member may be actuated to effect movement of the speaker along a pre-determined path at least substantially perpendicular to the main sound emission direction.

According to various embodiments, the movement member may include or may be or may be included in a dial (or a knob).

According to various embodiments, the headset may include an earpiece housing the speaker. According to various embodiments, the movement member may be mounted on the earpiece.

According to various embodiments, the headset may include a link mechanism.

According to various embodiments, the link mechanism may include a first link, a second link, and a third link. According to various embodiments, the speaker may be mounted on the first link and on the second link.

According to various embodiments, the first link may include a rail. According to various embodiments, the speaker may be mounted in (or on) the rail.

According to various embodiments, the speaker may be mounted to a first end of the second link.

According to various embodiments, the second link and the third link may be pivotally connected.

According to various embodiments, the third link and the first link may be pivotally connected.

According to various embodiments, the headset may include a plurality of speakers and a respective movement member for each speaker of the plurality of speakers.

According to various embodiments, the main sound emission direction may be at least substantially towards a user's ear.

According to various embodiments, a direction of the movement of the speaker may be up or down with respect to a user's head.

According to various embodiments, a direction of the movement of the speaker may be front or back with respect to a user's head.

According to various embodiments, the headset may be configured according to at least one of Dolby or DTS.

According to various embodiments, the speaker may include at least one of a left driver, a right driver, a back left driver, a back right driver, or a middle driver.

Figure 2A:
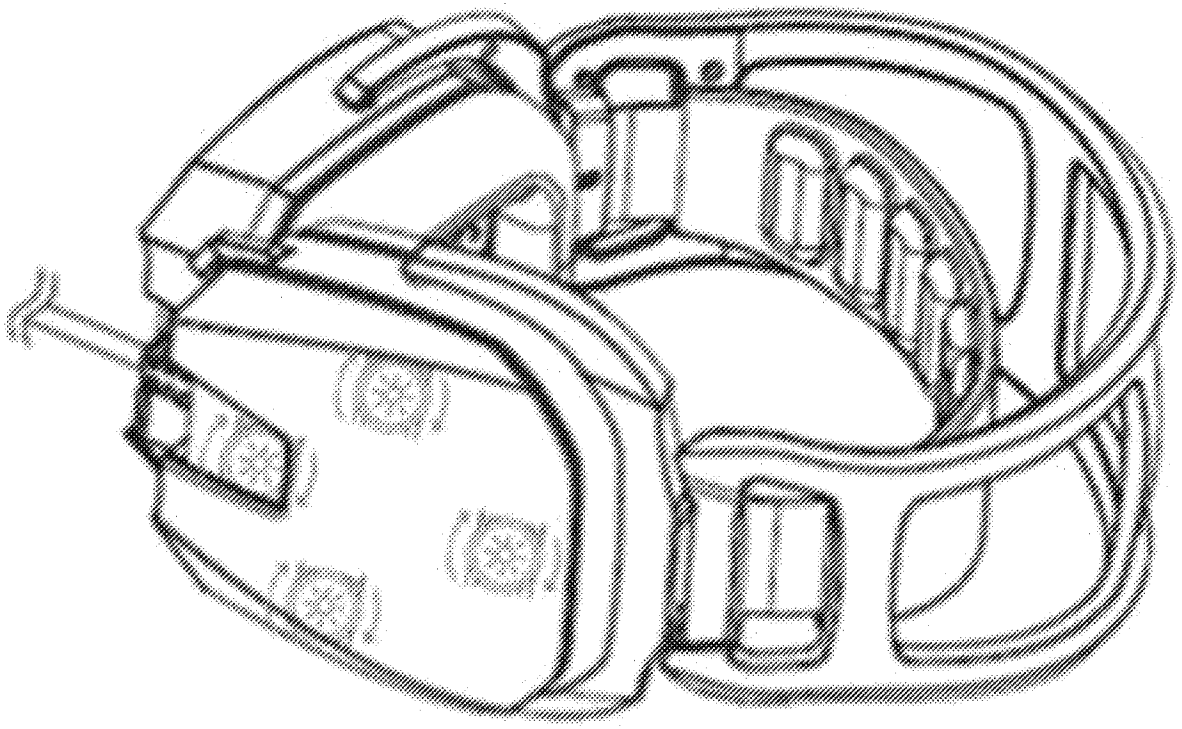
FIG. 2A shows a side view of a headset according to various embodiments.

FIG. 2A shows a side view 200 of a headset according to various embodiments.

Figure 2B:
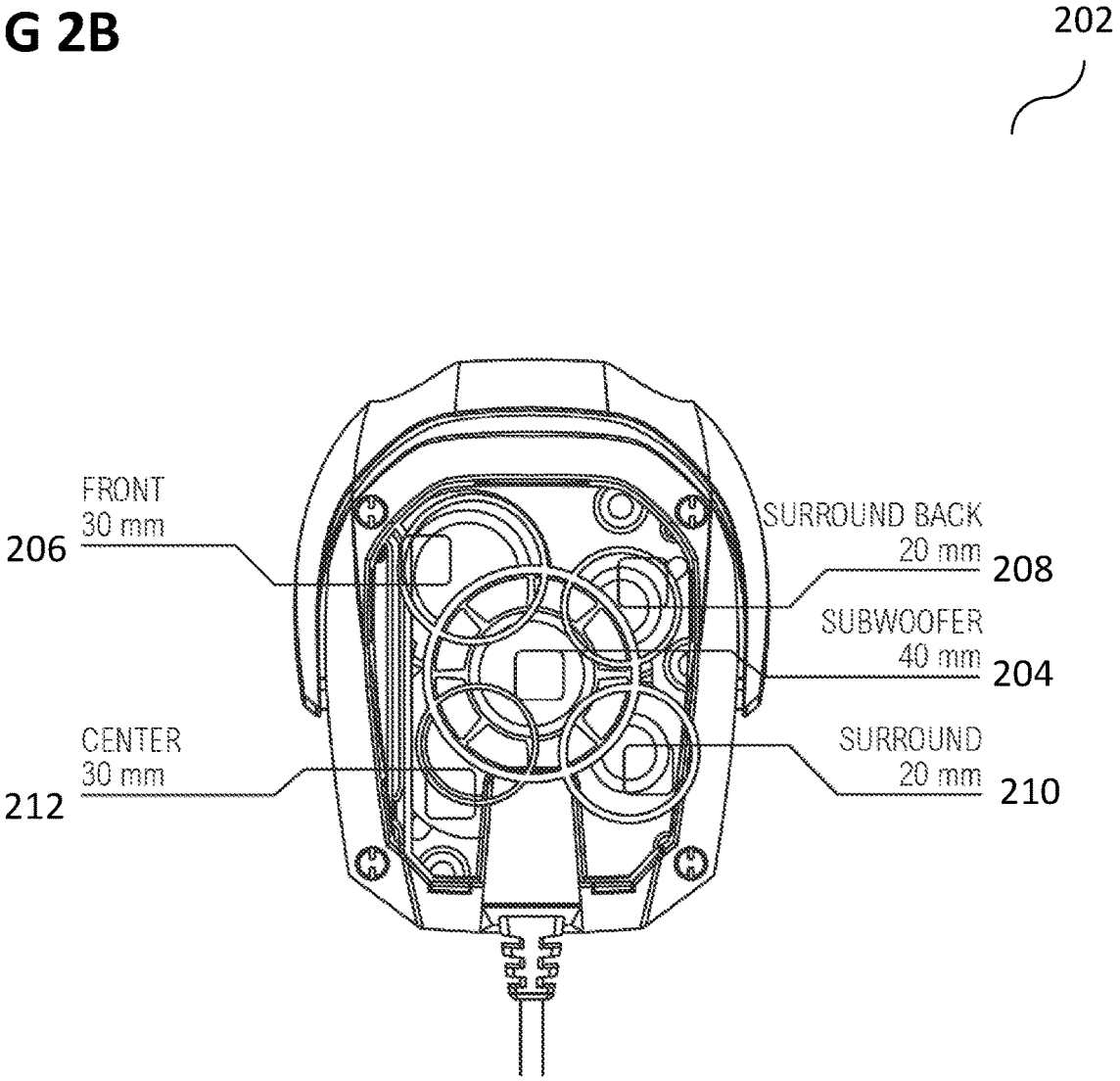
FIG. 2B shows a side view of a speaker arrangement according to various embodiments of the headset shown in FIG. 2A.

FIG. 2B shows a side view 202 of a speaker arrangement according to various embodiments of the headset shown in FIG. 2A. A front subwoofer 204 (having a diameter of for example 40 mm), a front speaker 206 (having a diameter of for example 30 mm), a surround back speaker 208, (having a diameter of for example 20 mm), a surround speaker 210 (having a diameter of for example 20 mm), and a center speaker 212 (having a diameter of for example 30 mm) are shown.

Figure 3:
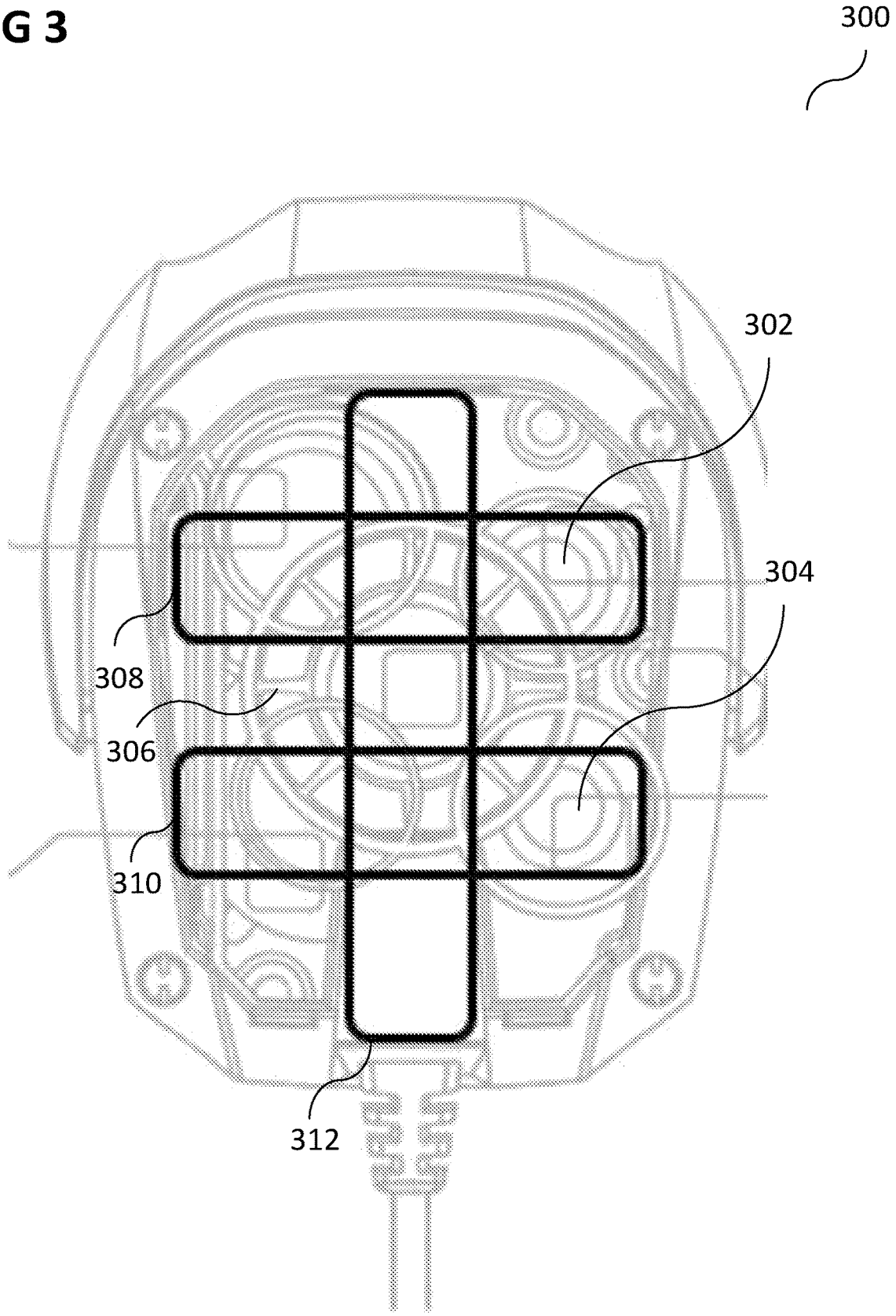
FIG. 3 shows a side view of a headset according to various embodiments.

FIG. 3 shows a side view 300 of a headset according to various embodiments.

According to various embodiments, a first driver 302, a second driver 304, and a third driver 306 may be adjusted via mechanical means to suit each individual user regardless of the user's ear size. For example, the first driver 302 may be moved along a first track 308. For example, the second driver 304 may be moved along a second track 310. For example, the third driver 306 may be moved along a third track 312.

Figure 4A:
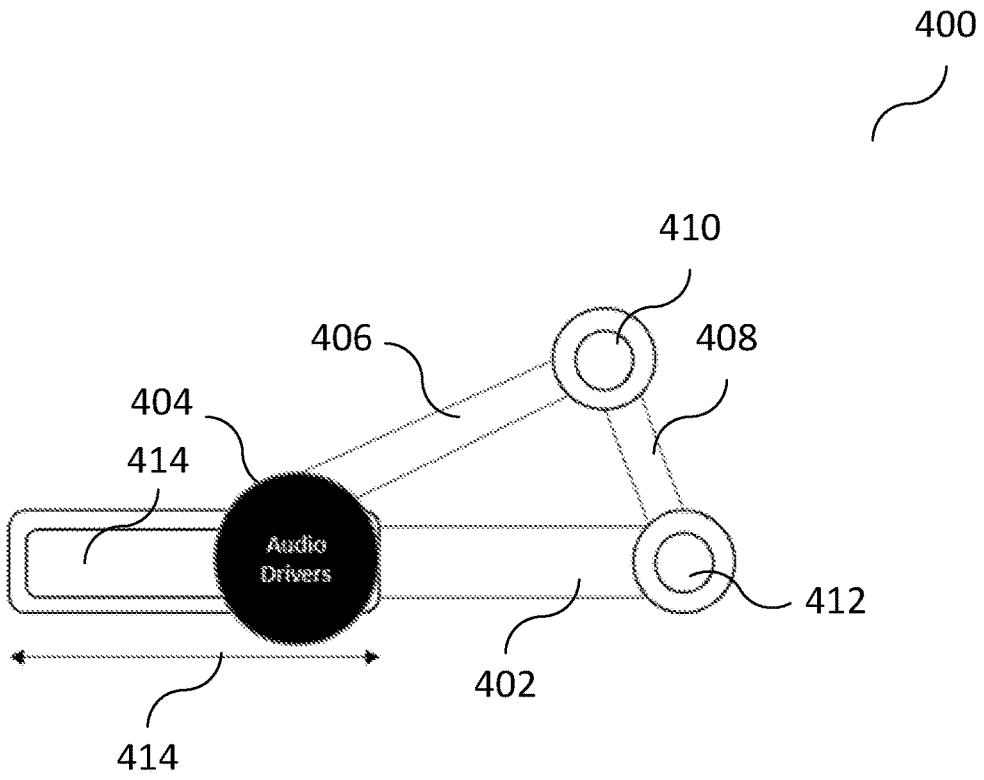
FIG. 4A shows an illustration of a mechanism according to various embodiments.

FIG. 4A shows an illustration 400 of a mechanism according to various embodiments. A driver 404 may be placed on a link mechanism (for example a slidable frame mechanism) which allows the driver 404 to move backwards and forwards by turning a dial clockwise and anti-clockwise respectively or vice versa. The slidable frame mechanism may include a first link 402, to which the driver 404 may be slidably mounted, for example in a rail 414. The slidable frame mechanism may further include a second link 406. The driver 404 may be mounted to a first end of the second link 406. A second end of the second link 406 may be pivotally connected to a first end of a third link 408, for example using a first joint 410. A second end of the third link 408 may be connected to a first end of the first link 402, for example using a second joint 412. A dial may be connected to the third link 408, for example with a rotational axis of the dial coinciding with the second joint 412. The rotatable dial may allow the driver 404 to move backwards and forwards, thereby allowing the user to adjust the driver 404 to move along a pre-determined path, for example along an at least substantially straight line (like indicated by arrow 414), to a desired position for an ideal soundscape or surround sound environment.

Figure 4B:
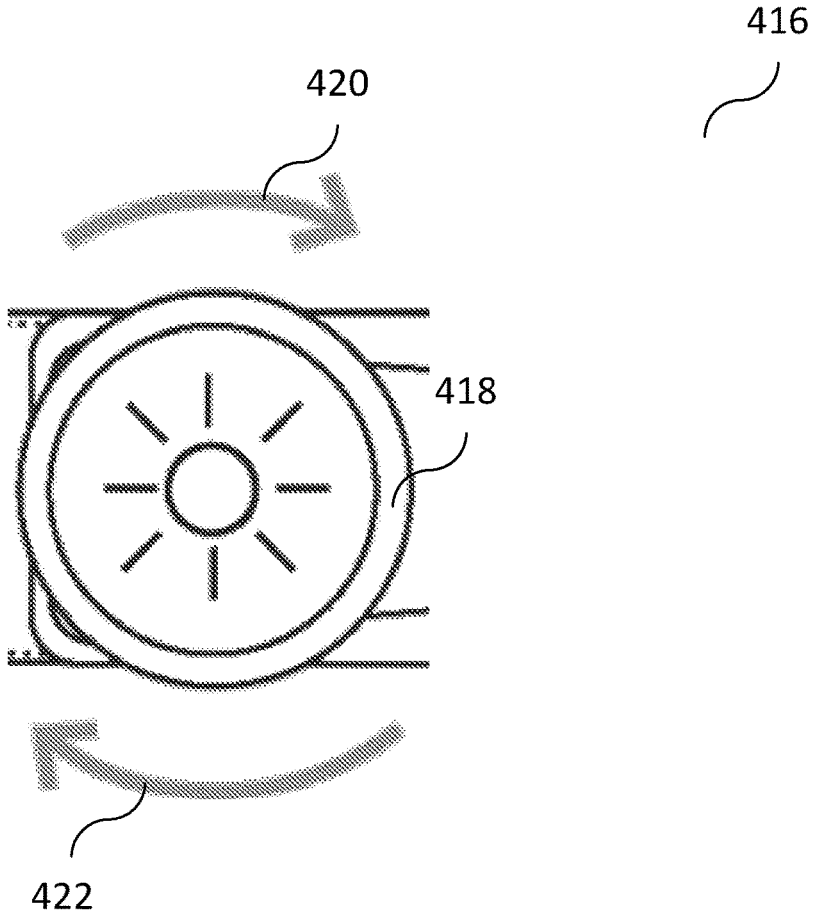
FIG. 4B shows an illustration of a turning dial according to various embodiments.

FIG. 4B shows an illustration 416 of a turning dial 418 according to various embodiments. The turning dial 418 may for example be provided at a location of the second joint 412 and be connected to the third link 408, so that the third link 408 is rotated around the second joint 412 upon actuation of the turning dial 418. The turning dial 418 may for example be turned in a clockwise manner (like indicated by a first arrow 420) or in an anti-clockwise manner (like indicated by a second arrow 422).

Figure 5:
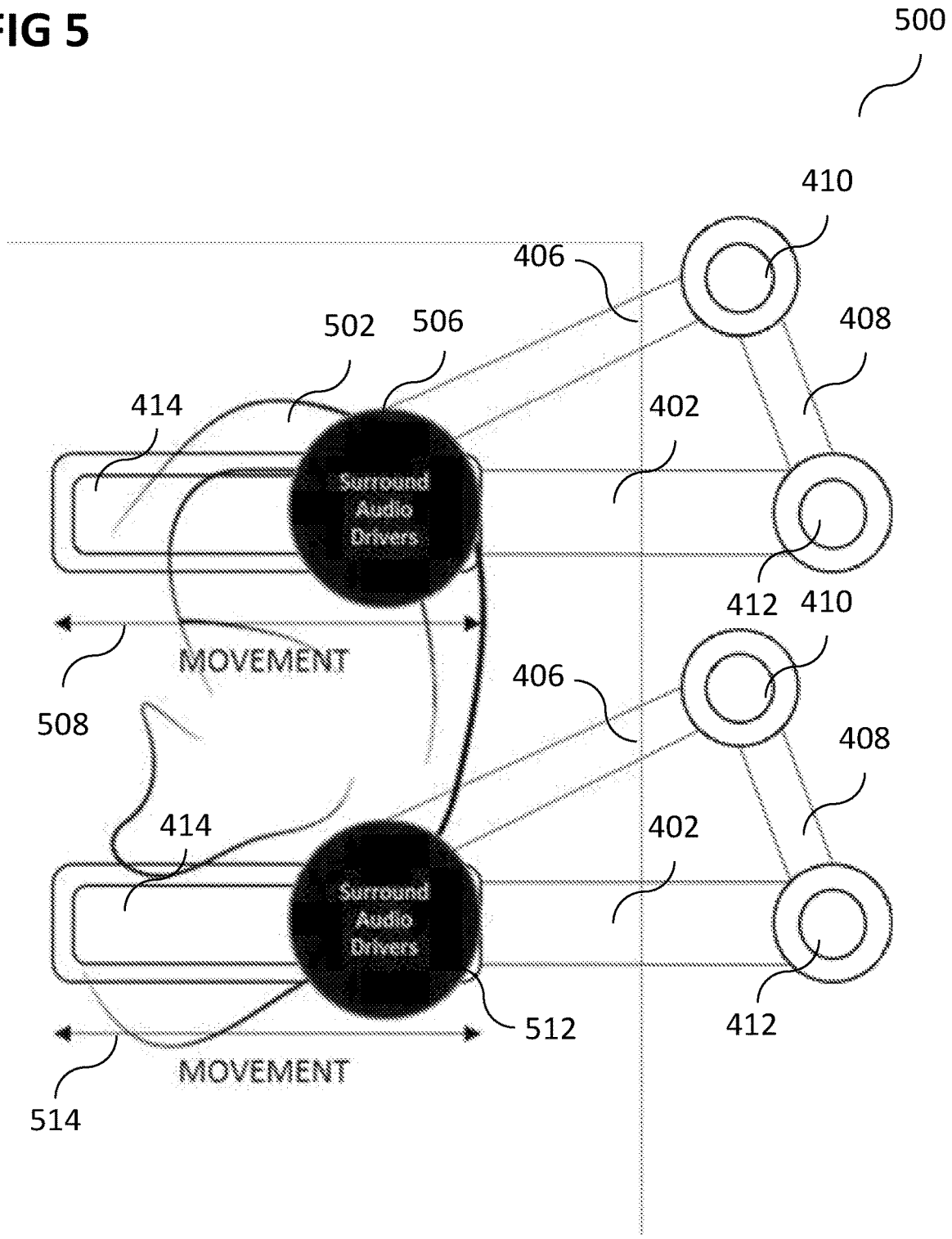
FIG. 5 shows an illustration of movement according to various embodiments.

FIG. 5 shows an illustration 500 of movement according to various embodiments. According to various embodiments, a rotatable dial may allow a speaker driver (for example a first driver 506 and/or a second driver 512) to move laterally across a plane of the ear cup. It will be understood that for two moveable drivers, to rotatable dials may be provided (one dial for each driver). For example, the first driver 506 may be moved like indicated by arrow 508. For example, the second driver 512 may be moved like indicated by arrow 514.

It will be understood that when reference to a "driver" is made, a plurality of drivers may be provided on a common carrier, so as to move the plurality of drivers in a common direction, and only one turning dial may be provided for such a "driver" (which may include a plurality of drivers).

Perceived sound by a user's ear 502 may be directional and focused on proximity distance, for example sound coming from front left vs back left, so that according to various embodiments, the user may adjust the driver (or drivers) to a desired position for an ideal soundscape or surround sound environment.

According to various embodiments, for example up to five drivers in each ear cup may be adjustable, and input jacks may be directly plugged into a 5.1/7.1 surround sound card which may separates the sound channels via existing standards (for example Dolby or DTS (Dedicated To Sound)). For example, the following adjustable drivers may be provided: a left driver, a right driver, a back left driver, a back right driver, and/or a middle driver.

According to various embodiments, a plurality of drivers in a headset may be provided, wherein each of the drivers of the plurality of drivers may be physically adjusted in position in relation to a source. For example, the surround back drivers may be adjusted to be further behind, and thereby, an ideal soundscape that a user may desire may be achieved.

According to various embodiments, mechanical dials and knobs may be provided to adjust the position of the speaker drivers to enhance the surround sound effect.

Various embodiments may be built onto the current sound encoding standard e.g. Dolby/DTS 5.1 surround sound, whereby the rear audio, front left audio and front right audio may be enhanced through positional audio drivers.

The following examples pertain to further embodiments.

Example 1 is a headset (in other words: headset device) comprising: a speaker having a main sound emission direction; and a movement member configured to effect movement of the speaker along a pre-determined path at least substantially perpendicular to the main sound emission direction upon actuation of the movement member.

In example 2, the subject-matter of example 1 can optionally include that the movement member comprises a dial.

In example 3, the subject-matter of any one of examples 1 to 2 can optionally include an earpiece housing the speaker; wherein the movement member is mounted on the earpiece.

In example 4, the subject-matter of any one of examples 1 to 3 can optionally include a link mechanism.

In example 5, the subject-matter of example 4 can optionally include that the link mechanism comprises a first link, a second link, and a third link; wherein the speaker is mounted on the first link and on the second link.

In example 6, the subject-matter of example 5 can optionally include that the first link comprises a rail; wherein the speaker is mounted in the rail.

In example 7, the subject-matter of any one of examples 5 to 6 can optionally include that the speaker is mounted to a first end of the second link.

In example 8, the subject-matter of any one of examples 5 to 7 can optionally include that the second link and the third link are pivotally connected.

In example 9, the subject-matter of any one of examples 5 to 8 can optionally include that the third link and the first link are pivotally connected.

In example 10, the subject-matter of any one of examples 1 to 9 can optionally include that the headset comprises a plurality of speakers and a respective movement member for each speaker of the plurality of speakers.

In example 11, the subject-matter of any one of examples 1 to 10 can optionally include that the main sound emission direction is at least substantially towards a user's ear.

In example 12, the subject-matter of any one of examples 1 to 11 can optionally include that a direction of the movement of the speaker is up or down with respect to a user's head.

In example 13, the subject-matter of any one of examples 1 to 12 can optionally include that a direction of the movement of the speaker is front or back with respect to a user's head.

In example 14, the subject-matter of any one of examples 1 to 13 can optionally include that the headset is configured according to at least one of Dolby or DTS.

In example 15, the subject-matter of any one of examples 1 to 14 can optionally include that the speaker comprises at least one of a left driver, a right driver, a back left driver, a back right driver, or a middle driver.

Example 16 is a method for configuring a headset with a speaker having a main sound emission direction, the method comprising: actuating a movement member to effect movement of the speaker along a pre-determined path at least substantially perpendicular to the main sound emission direction.

In example 17, the subject-matter of example 16 can optionally include that the movement member comprises a dial.

In example 18, the subject-matter of any one of examples 16 to 17 can optionally include that the headset comprises an earpiece housing the speaker; and wherein the movement member is mounted on the earpiece.

In example 19, the subject-matter of any one of examples 16 to 18 can optionally include that the headset comprises a link mechanism.

In example 20, the subject-matter of example 19 can optionally include that the link mechanism comprises a first link, a second link, and a third link; wherein the speaker is mounted on the first link and on the second link.

In example 21, the subject-matter of example 20 can optionally include that the first link comprises a rail; wherein the speaker is mounted in the rail.

In example 22, the subject-matter of any one of examples 20 to 21 can optionally include that the speaker is mounted to a first end of the second link.

In example 23, the subject-matter of any one of examples 20 to 22 can optionally include that the second link and the third link are pivotally connected.

In example 24, the subject-matter of any one of examples 20 to 23 can optionally include that the third link and the first link are pivotally connected.

In example 25, the subject-matter of any one of examples 16 to 24 can optionally include that the headset comprises a plurality of speakers and a respective movement member for each speaker of the plurality of speakers.

In example 26, the subject-matter of any one of examples 16 to 25 can optionally include that the main sound emission direction is at least substantially towards a user's ear.

In example 27, the subject-matter of any one of examples 16 to 26 can optionally include that a direction of the movement of the speaker is up or down with respect to a user's head.

In example 28, the subject-matter of any one of examples 16 to 27 can optionally include that a direction of the movement of the speaker is front or back with respect to a user's head.

In example 29, the subject-matter of any one of examples 16 to 28 can optionally include that the headset is configured according to at least one of Dolby or DTS.

In example 30, the subject-matter of any one of examples 16 to 29 can optionally include that the speaker comprises at least one of a left driver, a right driver, a back left driver, a back right driver, or a middle driver.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A headset comprising:

an ear cup comprising:

a speaker having a main sound emission direction; and a rotatable dial configured to effect movement of the speaker laterally across a plane of the ear cup along a pre-determined path at least substantially perpendicular to the main sound emission direction upon actuation of the rotatable dial;

a link mechanism;

wherein the link mechanism comprises a first link, a second link, and a third link;

wherein the speaker is mounted on the first link and on the second link;

wherein the first link comprises a rail;

wherein the speaker is slidably mounted in the rail;

wherein the speaker is mounted to a first end of the second link;

wherein the second link is pivotally connected to the third link by a first joint between the second link and the third link;

wherein the third link is pivotally connected to the first link by a second joint between the third link and the first link.

2. The headset of claim 1, wherein the ear cup houses the speaker;

wherein the rotatable dial is mounted on the ear cup.

3. The headset of claim 1, wherein the headset comprises a plurality of speakers and a respective rotatable dial for each speaker of the plurality of speakers.

4. The headset of claim 1, wherein the main sound emission direction is at least substantially towards a user's ear.

5. The headset of claim 1, wherein a direction of the movement of the speaker is up or down with respect to a user's head.

6. The headset of claim 1, wherein a direction of the movement of the speaker is front or back with respect to a user's head.

7. The headset of claim 1, wherein the speaker comprises at least one of a left driver, a right driver, a back left driver, a back right driver, or a middle driver.

8. The headset of claim 1, wherein the pre-determined path is a substantially straight path.

9. The headset of claim 1, wherein the rotatable dial is configured to effect a translation of the speaker laterally across the plane of the ear cup along the pre-determined path.

10. A method for configuring a headset with an ear cup, the ear cup comprising a speaker having a main sound emission direction, the method comprising:

actuating a rotatable dial to effect movement of the speaker laterally across a plane of the ear cup along a pre-determined path at least substantially perpendicular to the main sound emission direction;

wherein the headset comprises a link mechanism;

wherein the link mechanism comprises a first link, a second link, and a third link;

wherein the speaker is mounted on the first link and on the second link:

wherein the first link comprises a rail;

wherein the speaker is slidably mounted in the rail;

wherein the speaker is mounted to a first end of the second link;

wherein the second link is pivotally connected to the third link by a first joint between the second link and the third link;

wherein the third link is pivotally connected to the first link by a second joint between the third link and the first link.

11. The method of claim 10, wherein the ear cup houses the speaker; and wherein the rotatable dial is mounted on the ear cup.

12. The method of claim 10, wherein the headset comprises a plurality of speakers and a respective rotatable dial for each speaker of the plurality of speakers.

13. The method of claim 10, wherein the main sound emission direction is at least substantially towards a user's ear.

14. The method of claim 10, wherein a direction of the movement of the speaker is up or down with respect to a user's head.

15. The method of claim 10, wherein a direction of the movement of the speaker is front or back with respect to a user's head.

16. The method of claim 10, wherein the speaker comprises at least one of a left driver, a right driver, a back left driver, a back right driver, or a middle driver.

* * * * *